United States Patent [19]

Miller et al.

[11] Patent Number: 4,972,054

[45] Date of Patent: Nov. 20, 1990

[54] REDUNDANT SENSING EDGE FOR A DOOR

[75] Inventors: Norman K. Miller; Bearge D. Miller, both of Concordville, Pa.

[73] Assignee: Miller Edge, Inc., Concordville, Pa.

[21] Appl. No.: 491,781

[22] Filed: Mar. 12, 1990

Related U.S. Application Data

[63] Continuation-in-part of Ser. No. 396,493, Aug. 21, 1989, Pat. No. 4,908,483, and a continuation-in-part of Ser. No. 384,348, Jul. 21, 1989, abandoned.

[51] Int. Cl.[5] ..... H01H 3/16

[52] U.S. Cl. ..... 200/61.43

[58] Field of Search ..... 200/61.43, 86 A, 86 R, 200/85 R; 49/26, 27, 28

[56] References Cited

U.S. PATENT DOCUMENTS

| | | | |
|---|---|---|---|
| 3,133,167 | 5/1964 | Miller | 200/61.43 |
| 3,243,540 | 3/1966 | Miller | 200/86 R |
| 3,260,812 | 7/1966 | Miller | 200/61.43 |
| 3,315,050 | 4/1967 | Miller | 200/61.43 |
| 3,986,577 | 10/1976 | Ebbesson et al. | 180/275 |
| 4,045,631 | 8/1977 | Dann | 200/61.43 |
| 4,051,336 | 9/1977 | Miller | 200/61.43 |
| 4,349,710 | 9/1982 | Miller | 200/61.43 |
| 4,396,814 | 8/1983 | Miller | 200/61.43 |
| 4,620,072 | 10/1986 | Miller | 200/81 R |
| 4,785,143 | 11/1988 | Miller | 200/61.43 |

*Primary Examiner*—J. R. Scott

*Attorney, Agent, or Firm*—Panitch Schwarze Jacobs & Nadel

[57] ABSTRACT

A redundant sensing edge for a door to protect persons, equipment and the door from impact damage by actuating a device upon force being applied to the sensing edge. The sensing edge includes a flexible air impervious elongate outer sheath which is compressible upon application of external pressure. An air impervious sealed first chamber is positioned within the elongate sheath. A pressure sensitive switch is in fluid communication with the chamber for sensing pressure change within the chamber, such that upon application of external pressure to the sheath, the pressure switch is actuated. A second chamber is positioned within the sheath proximate the first chamber. A second switch is positioned within the second chamber and includes a first sheet of resiliently compressible material, a first sheet of electrically conductive material, a layer of non-conductive material, a second sheet of electrically conductive material and a second sheet of resiliently compressible material layered in the recited order. Upon application of external pressure to the sheath, a portion of at least one of the first and second sheets of electrically conductive material deflects into an opening in the layer of non-conductive material therebetween and makes electrical contact between the first and second sheets of electrically conductive material to thereby actuate the device.

10 Claims, 1 Drawing Sheet

REDUNDANT SENSING EDGE FOR A DOOR

REFERENCE TO RELATED APPLICATIONS

This application is a continuation-in-part of U.S. patent application Ser. No. 396,493, filed on Aug. 21, 1989, now U.S. Pat. No. 4,908,483, issued on Mar. 13, 1990 and co-pending U.S. patent application Ser. No. 384,348, filed on July 21, 1989, now abandoned.

FIELD OF THE INVENTION

The present invention relates to a sensing edge for a door and, more particularly, to a redundant sensing edge for a door to protect, persons, equipment and the door from impact damage by actuating a device upon force being applied to the sensing edge.

BACKGROUND OF THE INVENTION

Employing pressure switches in sensing edges for doors is generally known. Such sensing edges generally include a sheath having several openings or chambers therein in fluid communication with each other, in order to transmit therebetween pressure changes in response to the application of external pressure to the sheath. The problem associated with such edges, is that in order to construct several openings or chambers in fluid communication with each other, a plurality of different types and structures of foam must be used within the sheath to provide the proper sensitivity and path to communicate the pressure changes therebetween. Therefore, constructing and assembling door edges of this type is costly.

Other types of more conventional door edges include a pair of upper or lower, flexible, electrically conductive sheets (e.g., aluminum foil) positioned on the upper and lower sides of a bridge. Upon application of pressure to the sheath, the conductive sheets are deflected into electrically conductive engagement with each other to thereby function as a switch to actuate suitable control circuitry for controlling the door. Sensing edges with this type of construction may not be as sensitive as that contemplated by the present invention. For instance, before the control circuitry is actuated, the conductive sheets must travel the full distance therebetween, in order to make an electrical connection. Moreover, forces which are applied to the sides of the sheath will not necessarily cause the electrically conductive sheets to deflect into engagement with each other to actuate the switch.

Generally, in switches of this type, there is required a highly localized deflection to operate the switch. Even a substantial force or weight may not be sufficient to actuate such a switch, if the force or weight is distributed over a substantial area. In an attempt to obviate this problem, such switches often include internal protrusions for locally enhancing internal forces reacting to an external weight. This structure adds to the cost of the materials, complexity of manufacture, and often inhibits or reduces flexibility and, therefore, requires additional space for shipping and storage.

Consequently, there exists a need for a high profile sensing edge to improve over travel compensation. There further exists a need for a sensing edge which will respond to forces applied anywhere along the surface of the sheath, including sideward acting forces.

There also exists a need for a switch which includes at least two independent sensing means to prevent total failure of the switch in the event that one of the sensing means ceases operation.

The present invention is directed to a redundant sensing edge for a door to protect persons, equipment and the door from impact damage by actuating a device upon force being applied to the sensing edge. The switch of the present invention is of relatively high profile and is sensitive to pressure being applied to any exposed surface of the sheath. In addition, the present invention overcomes the problems inherent in the conventional prior art sensing edges by incorporating an air impervious chamber having a pressure switch therein for sensing pressure change within the chamber, and a second chamber incorporating two sheets of electrically conductive material with a layer of non-conductive material therebetween for providing an additional sensing capability.

SUMMARY OF THE INVENTION

Briefly stated, the present invention comprises a redundant sensing edge for a door to protect persons, equipment and the door from impact damage by actuating a device (not shown) upon force being applied to the sensing edge. The device is employed for either locking the door in place or for repositioning the door to the open position. The sensing edge comprises an elongate outer sheath compressible upon application of external pressure and fabricated of flexible air impervious material. The sheath has a front surface, a back surface, a lower surface and an upper surface, the upper surface for being attached to a door edge. An air impervious sealed first chamber is positioned within the elongate sheath. A first pressure sensitive switch having a switch element is in fluid communication with the first chamber for sensing pressure change within the first chamber, such that upon application of external pressure to the sheath, pressure within the first chamber is increased, and thereby communicated to the pressure switch for actuation thereof to thereby actuate the device. A second chamber is positioned within the sheath proximate the lower surface for receiving a second switch. The second switch comprises a first sheet of resiliently compressible material having a first face and a second face. The switch further includes a first sheet of electrically conductive material having a first face and a second face. The first face of the first sheet of electrically conductive material is in engagement with the second face of the first sheet of resiliently compressible material. A layer of non-conductive material having a first face and a second face is in engagement with the first sheet of electrically conductive material. Specifically, the first face of the layer of non-conductive material is in engagement with the second face of the first sheet of electrically conductive material. The layer of non-conductive material includes at least one opening extending therethrough between the first and second faces thereof. A second sheet of electrically conductive material is provided and has a first face and a second face. The first face of the second sheet of electrically conductive material is in engagement with the second face of the layer of non-conductive material. A second sheet of resiliently compressible material having a first face and a second face is in engagement with the second sheet of electrically conductive material. Specifically, the first face of the second sheet of resiliently compressible material is in engagement with the second face of the second sheet of electrically conductive material. The second face of the second sheet of resiliently compressible material is in engagement with the sheath. The first and second sheets of electrically conductive material are spaced apart by the layer of non-conductive material and present opposed portions to each other through the opening whereby upon the application of force to the sheath, a portion of at least one of the first and second sheets of electrically conductive material deflects into the opening in the layer of non-conductive material and makes electrical contact between the first and second sheets of electrically conductive material to thereby actuate the device.

BRIEF DESCRIPTION OF THE DRAWING

The foregoing summary, as well as the following detailed description of the preferred embodiment, is better understood when read in conjunction with the appended drawing. For the purpose of illustrating the invention, there is shown in the drawing an embodiment which is presently preferred, it being understood, however, that the invention is not limited to the specific methods and instrumentalities disclosed. In the drawing.

DETAILED DESCRIPTION OF PREFERRED EMBODIMENT

Figure 1:
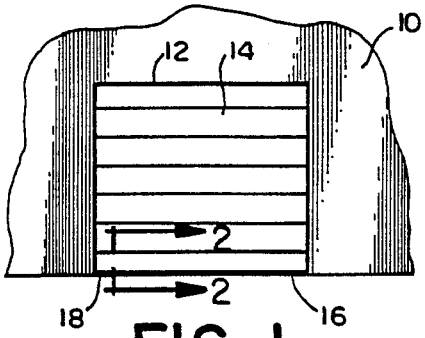
FIG. 1 is a front elevational view showing a door construction including a sensing edge in accordance with the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the redundant sensing edge and designated parts thereof. The terminology includes the words above specifically mentioned, derivatives thereof and words of similar import.

Figure 2:
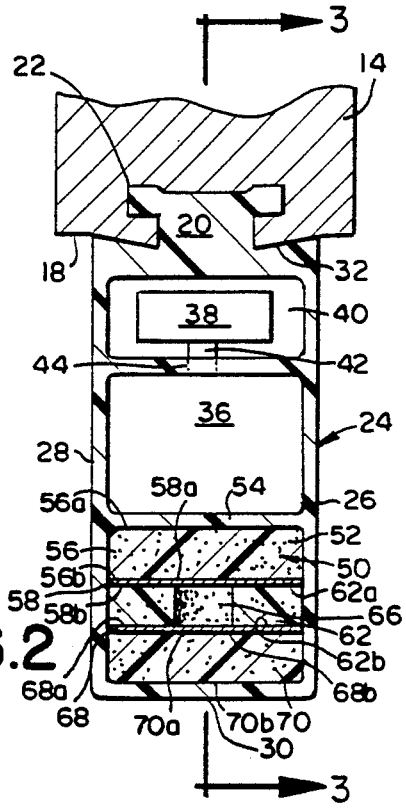
FIG. 2 is a greatly enlarged cross-sectional view of the sensing edge taken along line 2—2 of FIG. 1.
Figure 3:
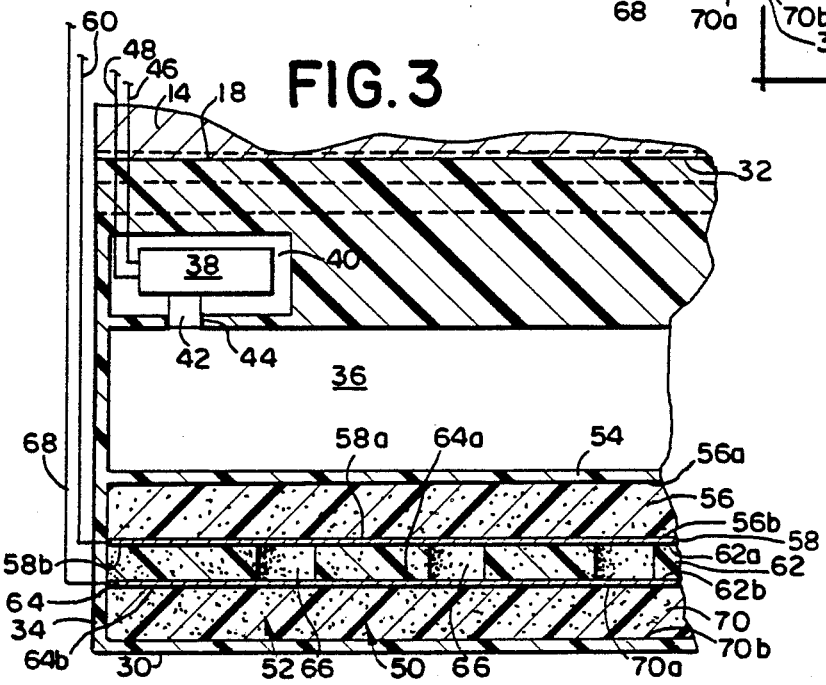
FIG. 3 is a cross-sectional view of the sensing edge taken along line 3—3 of FIG. 2.

Referring to the drawing in detail, wherein like numerals indicate like elements throughout, there is shown in FIGS. 1–3, a preferred embodiment of a redundant sensing edge in accordance with the present invention. There is shown in FIG. 1, a building wall 10 having a doorway 12 provided with a door 14. While the door 14, as illustrated, is an overhead door having a redundant sensing edge 16 in accordance with the present invention along its lower side or leading edge 18, it is within the spirit and scope of the invention to incorporate the sensing edge 16 described hereinafter along the edge of any door structure, such as vertically disposed or horizontally moveable doors (not shown) as desired. Moreover, it is understood by those skilled in the art, that the redundant sensing edge 16 is not limited to use in connection with doors, but can be used for other applications, such as automatic windows.

Referrring now to FIG. 2, the sensing edge 16 and the door 14 include securing means for fixing the sensing edge 16 to the leading edge 18 of the door 14. In the presently preferred embodiment, the securing means is comprised of a generally T-shaped member 20 on the sensing edge 16 positioned within a complementary T-shaped slot 22 in the lower surface of the door 14. Of course, the sensing edge 16 may be secured to the door 14 in any other suitable manner, for instance, with a traditional dove tail slot configuration (not shown). Moreover, it is also within the spirit and scope of the invention to secure the sensing edge 16 to the leading edge 18 of the door 14 by an adhesive (not shown) applied between the leading edge 18 and the peripheral face of the sensing edge 16.

Referring now to FIGS. 2 and 3, the sensing edge 16 is comprised of an elongate outer sheath 24 compressible upon application of external pressure and fabricated of flexible air impervious material. The sheath 24 has a front surface 26, a back surface 28, and lower surface 30, and an upper surface 32 including the T-shaped member 20 for being attached to the leading edge 18. It is preferred that the sheath 24 have a generally constant cross-sectional outline configuration, extending closely along the leading edge 18 of the door 14. In the present embodiment, the sheath 24 is generally of rectangular cross section, but may be of any other suitable shape, such as circular or semi-circular (not shown).

In the present embodiment, it is preferred that the sheath 24 be advantageously fabricated of a form-retaining, but flexible air impervious material, such as rubber. The lower surface 30 of the sheath is for engagement with the door threshold or ground (see FIG. 1). The front and back surfaces 26 and 28, upstand integrally from opposite side edges of the lower surface 30. The upper surface extends between the upper edges of the front and back surfaces 26 and 28 in close facing or complementary relation with the leading edge 18. The T-shaped member 22 is formed with the sheath 24 along the upper surface 32 for releasably interconnecting engagement with the leading edge 18, thereby facilitating quick and easy mounting or removal and replacement of the sensing edge 16 with respect to the door 14. As shown in FIG. 3, end walls 34 close and seal the ends of the sheath 24.

Referring now to FIGS. 2 and 3, an air impervious sealed first chamber 36 is positioned within the sheath 24. As shown in FIG. 2, the first chamber 36 is generally rectangular in cross-section and is generally in the form of a parallelpiped. The first chamber 36 is preferably air tight and formed as part of the sheath 24 during the manufacturing process. While it is preferred that the first chamber be generally rectangular in cross-section, it is understood by those skilled in the art, that other cross-sectional shapes and configurations, such as square or oval (not shown) could be utilized.

Referring now to FIG. 3, protectively located between the door 14 and the first chamber 36 is a pressure sensing means. In the presently preferred embodiment, the pressure sensing means comprises a first pressure sensitive switch 38 having a switch element in fluid communication with the first chamber 36 for sensing pressure change within the first chamber 36, such that upon application of external pressure to the sheath 24, pressure within the first chamber 36 is increased and thereby communicated to the pressure switch 38 for actuation thereof to thereby actuate the device. It is preferred that the pressure sensitive switch 38 be of the type in which electrical contact is either made or broken in response to sensed pressure changes. Switches of this type are well known in the art and generally commercially available. For instance, such pressure sensitive switches are manufactured by Micropneumatic Logic, Inc. of Fort Lauderdale, Fla.

If desired, the pressure sensitive switch 38 may be encased within protective material, such as foam (not shown) which may installed within the generally open area 40 within the sheath 24 in which the pressure sensitive switch 38 is installed.

The pressure sensitive switch 38 includes a pressure port or nipple 42 sealingly extending through an aperture 44 in the wall of the first chamber 36 to thereby communicate with the interior of the first chamber 36. The pressure sensitive switch 38 is provided with electrical conductors or wires 46, 48 which extend outwardly in sealed relation from the sheath 24 for connection with desired control circuitry (not shown) for actuating the device in a manner well known in the art.

Referring now to FIG. 3, the sensing edge 16 includes a second chamber 50 positioned within the sheath 24 proximate the lower surface 30 for receiving a second switch 52, described hereinafter. In the present embodiment, it is preferred that the first and second chambers 36, 50 be juxtapositioned within the sheath 24. More particularly, it is preferred that the first chamber 36 be positioned between the pressure sensitive switch 38 and the second chamber 50, and that the pressure sensitive switch 38 be positioned within the sheath 24 between the first chamber 36 and the upper surface 32. However, it is understood by those skilled in the art, that the pressure sensitive switch 38, first chamber 36 and second chamber 50 can be positioned within the sheath in other manners with respect to each other, without departing from the spirit and scope of the invention. For instance, the pressure sensitive switch 38 could be positioned within the first chamber 36 or the second chamber 50.

In the present embodiment, it is preferred that the second chamber 50 have the same general overall configuration as the first chamber 36. However, it is understood by those skilled in the art, that both the first and second chambers 36 and 50 can be of different shapes, such as semicircular or triangular and that the first and second chambers 36, 50 can be of different shapes with respect to each other.

Referring now to FIGS. 2 and 3, the first and second chambers 36, 50 are separated by an intermediate wall 54. A first sheet of resiliently compressible material 56 is positioned within the second chamber 50 and includes a first face **56*a* and a second face 56*b*. The first face 56*a* of the first sheet of resiliently compressible material 56 is in engagement or corresponding facing relationship with the intermediate wall 54**.

In the present embodiment, it is preferred that the first sheet of resiliently compressible material 56 and succeeding layers and sheets, described hereinafter, be generally sized to complement the internal configuration of the second chamber 50. However, it is understood by those skilled in the art, that the first sheet of resiliently compressible material 56 and succeeding layers can be sized as wide or as narrow as desired, and be of virtually of any length for accommodating different structures and uses.

In the present embodiment, it is preferred that the first sheet of resiliently compressible material 56 be constructed of generally soft foam rubber. It is understood by those skilled in the art that the first sheet of resiliently compressible material 56 can be constructed of either closed or opened cell foam rubber or of other materials having similar properties.

Just below (when viewing FIGS. 2 and 3) the first sheet of resiliently compressible material 56 is a first sheet of flexible, electrically conductive material 58, engaged therewith, and having a first face **58*a* and a second face 58*b*. The first face 58*a* of the first sheet of flexible, electrically conductive material 58 is in engagement or in corresponding facing relationship with the second face 56*b* of the first sheet of resiliently compressible material 56. In the present embodiment, it is preferred that the first sheet of flexible, electrically conductive material 58 be generally thin and preferably be constructed of aluminum or aluminum foil. However, it is within the spirit and scope of the invention to construct the first sheet of flexible, electrically conductive material 58** of other materials, such as copper, brass or an alloy thereof.

As shown in FIG. 3, an electrical conductor or wire 60 is electrically connected to the first sheet of flexible, electrically conductive material 58 preferably by soddering at one end thereof. The electrical conductor 60 is used in connection with a circuit (not shown) for controlling the actuation of the device or door 14, as is understood by those skilled in the art, in response to the application of force to the sheath 24, as described hereinafter.

The first sheet of flexible, electrically conductive material 58 is in engagement with a layer of non-conductive material 62 having a first face **62*a* and a second face 62*b* for spacing apart the first sheet of flexible, electrically conductive material 58 and a second sheet of flexible, electrically conductive material 64. The layer of non-conductive material 62 has at least one opening extending therethrough between the first and second faces 62*a*, 62*b* thereof. As shown in FIG. 3, the layer of non-conductive material 62, preferably includes a plurality of openings 66 interspersed therealong for allowing the actuation of the second switch 52 by applying pressure thereto, as described hereinafter. The first face 62*a* of the layer of non-conductive material 62 is in engagement or corresponding facing relationship with the second face 58*b* of the first sheet of flexible, electrically conductive material 58**.

In the present embodiment, it is preferred that the openings 66 be generally oval shaped in cross section. However, it is within the spirit and scope of the invention to configure the openings 66 of any geometric shape, such as square or circular.

The layer of non-conductive material 62 is preferably constructed of generally soft foam rubber. It is understood by those skilled in the art, that the layer of non-conductive material 62 can be constructed of either closed or open cell foam rubber or other materials having similar properties, so long as the function of the second switch 52 is achieved, as described hereinafter.

The layer of non-conductive material 62 is in engagement with a second sheet of flexible, electrically conductive material 64 having a first face **64*a* and a second face 64*b*. The first face 64*a* of the second sheet of flexible, electrically conductive material 64 is in engagement or corresponding facing relationship with the second face 62*b* of the layer of non-conductive material 62**.

In the present embodiment, it is preferred that the second sheet of flexible, electrically conductive material 64 be constructed of the same material and configuration as the first sheet of flexible, electrically conductive material 58. Similarly, the second sheet of flexible, electrically conductive material 64 is connected to an electrical conductor or wire 68 for connection with a circuit for controlling the actuation of the door 14 or device in response to the application of force to the second switch 52.

In engagement with the second sheet of flexible, electrically conductive material 64 is a second sheet of resiliently compressible material 70 having a first face **70*a*** and a second face 70*b*. The first face 70*a* of the second sheet of resiliently compressible material 70 is in engagement or corresponding facing relationship with the second face 64*b* of the second sheet of flexible, electrically conductive material 64. The second face 70*b* of the second sheet of resiliently compressible material 70 is in engagement with the sheath 24 proximate the lower surface 30.

The second sheet of resiliently compressible material 70 is preferably constructed of the same material and configured generally identically to the first sheet of resiliently compressible material 56. However, it is apparent to those skilled in the art, that the first and second sheets of resiliently compressible material 56, 70 can differ in configuration, size and/or material.

As shown in FIG. 3, the first and second sheets of flexible, electrically conductive material 58, 64 are spaced apart by the layer of non-conductive material 62 and present opposed portions to each other through the openings 66. Upon the application of force to the sheath 24, a portion of at least one of the first and second sheets of flexible, electrically conductive material 58, 64 deflects into at least one of the openings 66 in the layer of non-conductive material 62, and makes electrical contact between the first and second sheets of flexible, electrically conductive material 58, 64 to thereby actuate the device.

In use, the sheath 24 is connected to the door 14 using the T-shaped member 20 as described above. The electrical conductors or wires 46, 48, 60 and 68 are connected to a circuit (not shown) for controlling the operation or actuation of a device (not shown) for controlling the actuation of the door 14 in response to the application of force to the sheath. Specifically, upon the application of force to the front or back surfaces 26, 28, pressure within the first chamber 36 is increased and communicated to the pressure switch 38 for actuation thereof to complete or break electrical contact and to thereby actuate the device. Similarly, upon the application of force to the lower surface 30 of the sheath 24, a portion of at least one of the first and second sheets of flexible, electrically conductive material 58, 64 deflects into at least one of the openings 66 in the layer of non-conductive material 62 and makes electrical contact between the first and second sheets of electrically conductive material to thereby complete or enable the circuit to actuate the device and control the actuation of the door 14.

Depending upon the magnitude of the force applied to the lower surface 30, how fast the magnitude of the force increases or decreases over time, and the properties of the materials in which the sheath 24 and second switch 52 are constructed, it is understood by those skilled in the art, that when such force is applied to the lower surface 30, either the pressure sensitive switch 38 or the second switch 52 may be actuated first. Moreover, in the event that either the pressure sensitive switch 38 or the second switch 52 fails, the remaining operating switch still serves to actuate the device, thereby providing the sensing edge 16 with redundancy.

From the foregoing description, it can be seen that the present invention comprises a redundant sensing edge for a door to protect persons, equipment and the door from impact damage by actuating a device upon force being applied to the sensing edge. It is appreciated by those skilled in the art, that changes could be made to the embodiment described above without departing from the broad inventive concepts thereof. It is understood, therefore, that this invention is not limited to the particular embodiment disclosed, but it is intended to cover all modifications which are within the scope and spirit of the invention as defined by the appended claims.

We claim:

1. A redundant sensing edge for a door to protect persons, equipment and the door from impact damage by actuating a device upon force being applied to said sensing edge, said sensing edge comprising:

an elongate outer sheath compressible upon application of external pressure and fabricated of flexible air impervious material, said sheath having a front surface, a back surface, a lower surface and an upper surface, said upper surface for being attached to a door edge;

an air impervious sealed first chamber positioned within said elongate sheath;

a first pressure sensitive switch having a switch element in fluid communication with said first chamber for sensing pressure change within said first chamber such that upon application of external pressure to said sheath, pressure within the first chamber is increased and thereby communicated to the pressure switch for actuation thereof to thereby actuate the device;

a second chamber positioned within said sheath proximate said lower surface for receiving a second switch, said second switch comprising:

a first sheet of resiliently compressible material having a first face and a second face;

a first sheet of electrically conductive material having a first face and a second face, said first face of said first sheet of electrically conductive material being in engagement with said second face of said first sheet of resiliently compressible material;

a layer of non-conductive material having a first face and a second face, said first face of said layer of non-conductive material being in engagement with said second face of said first sheet of electrically conductive material, said layer of non-conductive material including at least one opening extending therethrough between said first and second faces thereof;

a second sheet of electrically conductive material having a first face and a second face, said first face of said second sheet of electrically conductive material being in engagement with said second face of said layer of non-conductive material;

a second sheet of resiliently compressible material having a first face and a second face said first face of said second sheet of resiliently compressible material being in engagement with said second face of said second sheet of electrically conductive material, said second face of said second sheet of resiliently compressible material being in engagement with said sheath, said first and second sheets of electrically conductive material being spaced apart by said layer of non-conductive material and present opposed portions to each other through said opening whereby upon the application of force to said sheath, a portion of at least one of said first and second sheets of electrically conductive material deflects into the opening in said layer of non-conductive material and makes electrical contact between said first and second sheets of electrically conductive material to thereby actuate the device.

2. The sensing edge as recited in claim 1, wherein said first chamber and said second chamber are juxtapositioned within said sheath.

3. The sensing edge as recited in claim 1, wherein said sheath includes an intermediate wall for segregating said first and second chambers.

4. The sensing edge as recited in claim 3, wherein said first face of said first sheet of resiliently compressible material is in engagement with said intermediate wall.

5. The sensing edge as recited in claim 1, wherein said pressure sensitive switch is positioned within said sheath between said first chamber and said upper surface.

6. The sensing edge as recited in claim 1, wherein said air impervious material is rubber.

7. The sensing edge as recited in claim 1, wherein said first and second sheets of resiliently compressible material are foam rubber.

8. The sensing edge as recited in claim 1, wherein said first and second sheets of electrically conductive material are aluminum.

9. The sensing edge as recited in claim 1, further including electrical conductors connected to each of said first and second sheets of electrically conductive material for connection with a circuit for controlling the actuation of the door in response to the application of force to said lower surface of said sheath.

10. The sensing edge as recited in claim 1, wherein said first chamber is positioned between said pressure sensitive switch and said second chamber.

* * * * *

UNITED STATES PATENT AND TRADEMARK OFFICE

CERTIFICATE OF CORRECTION

PATENT NO. : 4,972,054

DATED : 11/20/90

INVENTOR(S) : Norman K. Miller et al

It is certified that error appears in the above-identified patent and that said Letters Patent is hereby corrected as shown below:

On the title page [63] under Related U.S. Application Data: line 1, before "Ser. No. 384,348", insert --copending--.

Signed and Sealed this

Twenty-first Day of April, 1992

*Attest:*

HARRY F. MANBECK, JR.

*Attesting Officer*

*Commissioner of Patents and Trademarks*